US012313087B2

(12) United States Patent
Cornwell

(10) Patent No.: US 12,313,087 B2
(45) Date of Patent: May 27, 2025

(54) ENERGY-CONSERVING FLUID PUMP

(71) Applicant: Kinetic Technology Systems, LLC, Duxbury, MA (US)

(72) Inventor: Gary Cornwell, Melbourne, FL (US)

(73) Assignee: Kinetic Technology Systems, LLC, Duxbury, MA (US)

( * ) Notice: Subject to any disclaimer, the term of this patent is extended or adjusted under 35 U.S.C. 154(b) by 18 days.

(21) Appl. No.: 18/474,534

(22) Filed: Sep. 26, 2023

(65) Prior Publication Data

US 2024/0026903 A1 Jan. 25, 2024

Related U.S. Application Data

(63) Continuation-in-part of application No. 17/113,871, filed on Dec. 7, 2020, now Pat. No. 11,808,265.
(Continued)

(51) Int. Cl.
*F04D 29/66* (2006.01)
*F04D 13/02* (2006.01)
(Continued)

(52) U.S. Cl.
CPC ..... *F04D 29/669* (2013.01); *F04D 13/024* (2013.01); *F04D 13/06* (2013.01); *F04D 29/445* (2013.01)

(58) Field of Classification Search
CPC ..... F04D 29/669; F04D 13/024; F04D 13/06; F04D 29/445; F04D 29/448; F04D 29/4253; F04D 29/4293
See application file for complete search history.

(56) References Cited

U.S. PATENT DOCUMENTS 3,994,618 A * 11/1976 Erickson ..... F04D 1/12 415/89
4,251,184 A * 2/1981 Budrys ..... F04D 1/12 415/89
(Continued)

FOREIGN PATENT DOCUMENTS

CN 101158359 A * 4/2008 ..... D06B 23/00

OTHER PUBLICATIONS

International Search Report and Written Opinion for PCT Application No. PCT/US2024/046532 mailed Jan. 27, 2025.

*Primary Examiner* — Dominick L Plakkoottam
(74) *Attorney, Agent, or Firm* — Carlson, Gaskey & Olds, P.C.

(57) ABSTRACT

An energy-conserving fluid pump is an apparatus used to transport low viscosity fluids like water and fuel without experiencing cavitation, recirculation, nor motor locking while also conserving energy. The apparatus includes a fluid diffuser, a fluid densifier, a convergent housing, and a strut assembly. The fluid diffuser improves the efficiency of the apparatus by expanding the fluid inflow and maintaining a fluid pressure buildup. The fluid densifier shears the incoming fluid flow from the fluid diffuser and increases the fluid outflow pressure. The convergent housing encloses the fluid diffuser and the fluid densifier while facilitating the outflow of the pressurized fluid without the loss of fluid pressure nor cavitation. In addition, the convergent housing facilitates the transfer of torque to the fluid diffuser for the operation of the apparatus. The strut assembly keeps the fluid densifier stationary while enabling the rotation of the convergent housing and/or the fluid diffuser.

20 Claims, 19 Drawing Sheets

Related U.S. Application Data

(60) Provisional application No. 62/944,702, filed on Dec. 6, 2019.

(51) Int. Cl.
*F04D 13/06* (2006.01)
*F04D 29/44* (2006.01)

(56) References Cited

U.S. PATENT DOCUMENTS 4,252,499 A * 2/1981 Erickson ..... F04D 1/12 415/89
4,281,962 A * 8/1981 Erickson ..... F04D 1/12 415/89
4,355,951 A 10/1982 Grose
6,171,078 B1 1/2001 Schob
6,345,961 B1 * 2/2002 Oklejas, Jr. ..... F01D 3/00 417/407
6,565,315 B1 5/2003 Bertels et al.
6,709,227 B2 * 3/2004 Quinn ..... F04D 1/12 415/121.2
6,817,845 B2 * 11/2004 Angle ..... F04D 1/12 417/423.7
8,613,605 B2 12/2013 Hammar et al.
9,719,516 B2 * 8/2017 Neilson ..... F04D 1/12
10,151,314 B2 * 12/2018 Neilson ..... F04D 29/4293
2006/0198731 A1 9/2006 Shaw et al.
2006/0245959 A1 * 11/2006 LaRose ..... F04D 13/0646 417/423.5
2010/0284812 A1 11/2010 Zahdeh
2013/0209292 A1 * 8/2013 Baykut ..... A61M 60/806 415/73
2018/0283399 A1 10/2018 Gu et al.
2020/0392960 A1 * 12/2020 Stuiver ..... F04D 3/00
2021/0172441 A1 6/2021 Cornwell
2024/0026903 A1 1/2024 Cornwell

* cited by examiner

ENERGY-CONSERVING FLUID PUMP

The current application is a continuation-in-part of U.S. patent application Ser. No. 17/113,871 filed on Dec. 7, 2020, which claims priority to the U.S. Provisional Patent application Ser. No. 62/944,702 filed on Dec. 6, 2019.

FIELD OF THE INVENTION

The present invention relates generally to centrifugal fluid pumps. More specifically, the present invention is a pump designed for energy conservation and reduction of cavitation by driving the pump with the housing together and by utilizing size-reducing channels.

BACKGROUND OF THE INVENTION

Typical pumps on the market today fall into two categories: centrifugal pumps and positive displacement pumps. Each type of pump classification has clearly different characteristics that set the two apart. In contrast, the present invention is unique in that it incorporates both. The present invention has unique characteristics that set it apart from all other fluid pumps by having the pump and pump housing rotate on the same axle. Currently, there is nothing like the present invention on the market today. The faster the present invention rotates, the higher the Gallons Per Minute (GPM) produced as well as a higher flow pressure. The present invention can run in a range of 1000 to 100,000 RPMs with no cavitation. In comparison, typical centrifugal pumps are limited to about 3500 RPMs due to cavitation issues.

To compare the present invention to typical pumps, the assumption is that all pumps have no pressure relief valve to compare each pump at the same comparative level. In addition, the pump is turned on and left on:

- When the fluid is stopped in a running typical centrifugal pump, the pump will continue to run, churning up the fluid within the housing/volute, and allowing cavitation and recirculation to occur. Also, there will be no fluid flow and no pressure gain with increased RPMs. This condition is caused due to the pump/impeller rotating independent of the housing where there are gaps around the impeller, thus allowing fluid to slosh around. Results: high load condition, high energy loss and no work done.
- With hydraulic positive displacement pumps (gear, rotor, diaphragm, or piston pumps) fluid is pushed through the pump by brute force from the driving motor. If flow is stopped, the driving motor will lock and stop rotating. This phenomenon happens due to the physics of liquid not being able to be compressed. Results: high energy loss, ruined motor, no work done.
- If the fluid in the pump of the present invention is stopped, no hydraulic lock occurs and the pump will stay rotating with no flow; however, the pressure will continue to increase with increased RPMs. The energy effects of a no flow condition using the pump of the present invention is essentially rotating the mass of the pump and fluid within. There will be a no load, no cavitation, no recirculation of fluid, and low energy condition. The same condition occurs when covering the suction hose on a vacuum cleaner, the RPMs increase and current decreases, thus eliminating the load which is the moving air. With an increase in RPMs, there will be an increase in Counter Electro Motive Force (CEMF), creating an increased electrical resistance, thus decreasing current flow/lower cost.

No other fluid pump on the market today performs like the present invention. Further, the pump of the present invention size-decreasing channels that increase pressure as the fluid moves through the channels. All these features make the pump of the present invention the best pump for water desalinization as well as for other applications. Additional benefits and features of the present invention are further discussed in the following sections.

SUMMARY OF THE INVENTION

The present invention provides an energy-conserving fluid pump including a convergent housing, a fluid diffuser, and a fluid densifier. The components are connected and locked together to rotate together as one sealed unit, except for the fluid densifier. The flowing fluid is constantly building pressure as the fluid moves through the energy-conserving fluid pump, eliminating the possibility of cavitation within the convergent housing. Once the fluid leaves the fluid diffuser, the flowing fluid is immediately sheared by the stationary fluid densifier, sent downward to the center of rotation of the convergent housing, and then out of the convergent housing without rotating itself. The fluid densifier multiplies the pressure of the fluid traveling through the fluid densifier until the fluid is redirected to a housing outlet.

Another disclosed feature positions a force plate between the fluid diffuser and the fluid densifier. The force plate rotates with the fluid diffuser and the convergent housing. The force plate functions to increase the pressure of the fluid downstream of the fluid diffuser.

DETAILED DESCRIPTION OF THE INVENTION

Figure 1:
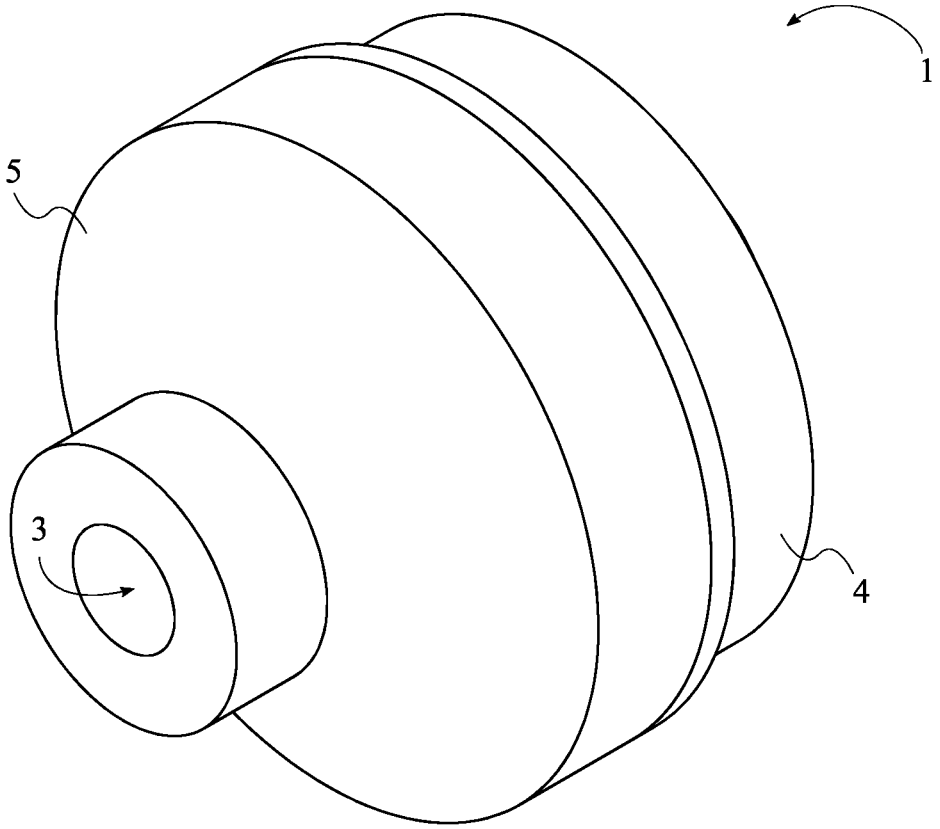
FIG. 1 is a top front perspective view showing the energy-conserving fluid pump.
Figure 2:
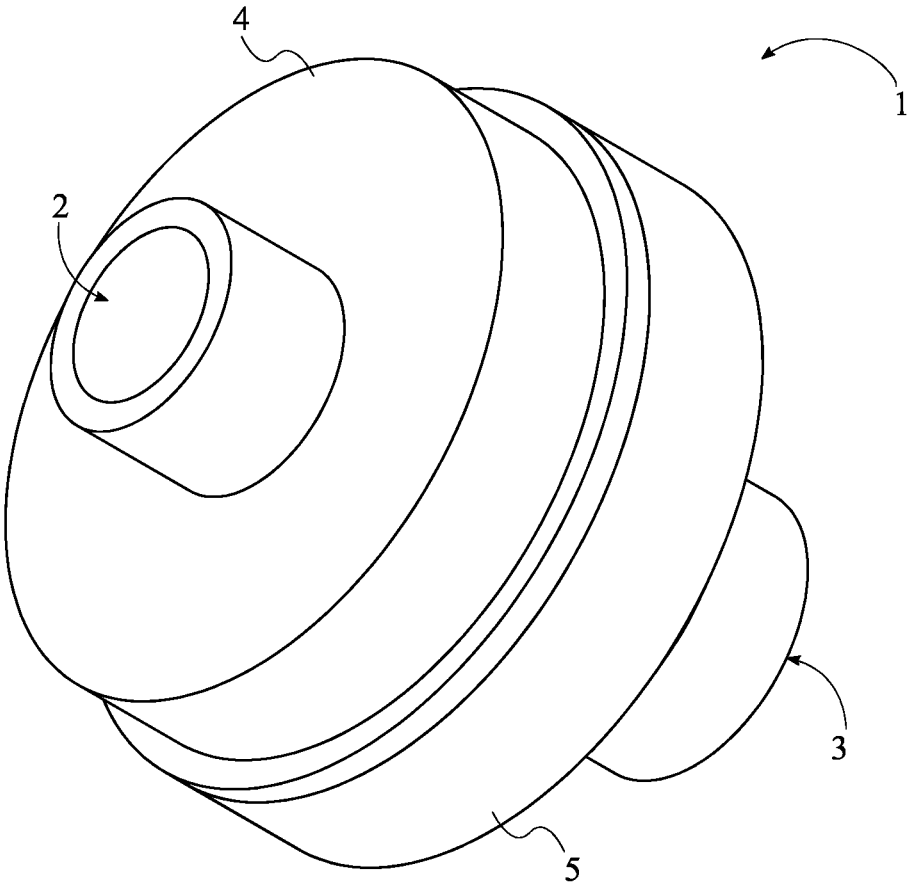
FIG. 2 is a bottom rear perspective view showing the energy-conserving fluid pump.

All illustrations of the drawings are for the purpose of describing selected versions of the present invention and are not intended to limit the scope of the present invention.

The present invention is an energy-conserving fluid pump which prevents cavitation, recirculation, and motor locking while conserving energy. The present invention can transport low viscosity fluids like water and fuel, and the primary application of the present invention is water desalinization and propulsion where high pressure along with high volume and reduced energy usage are crucial. As can be seen in FIG. 1 through 4, the present invention may comprise a fluid diffuser 7, a fluid densifier 13, and a convergent housing 1. The fluid diffuser 7 improves the efficiency of the present invention by expanding the fluid inflow. The fluid densifier 13 shears the fluid flow from the fluid diffuser 7 and increases the fluid outflow pressure. The convergent housing 1 encloses the fluid diffuser 7 and the fluid densifier 13 while facilitating the outflow of the pressurized fluid without the loss of fluid pressure nor cavitation. In addition, the convergent housing 1 facilitates the transfer of torque to the fluid diffuser 7 for the operation of the present invention.

The general configuration of the aforementioned components allows the present invention to transport low viscosity fluids while preserving energy, preventing cavitation, and maintaining a high-pressure output. As can be seen in FIG. 5 through 8, the fluid densifier 13 comprises a densifier body 14, a plurality of densifier inlets 17, a densifier outlet 18, and a plurality of spiraling channels 19. Also, the densifier body 14 comprises a first densifier face 15 and a second densifier face 16. The convergent housing 1 comprises a housing inlet 2 and a housing outlet 3 to enable the fluid flow through the convergent housing 1. The fluid diffuser 7 and fluid densifier 13 are not rotatably mounted to each other so that the fluid diffuser 7 can rotate about axis X. However, the fluid densifier 13 does not rotate with the fluid diffuser 7. As disclosed below, fluid densifier 13 is fixed. In addition, the fluid diffuser 7 and the fluid densifier 13 are positioned within the convergent housing 1 so that the fluid diffuser 7 and the fluid densifier 13 are sealed within. Thus, no sloshing happens within the convergent housing 1 during or after operation.

Figure 3:
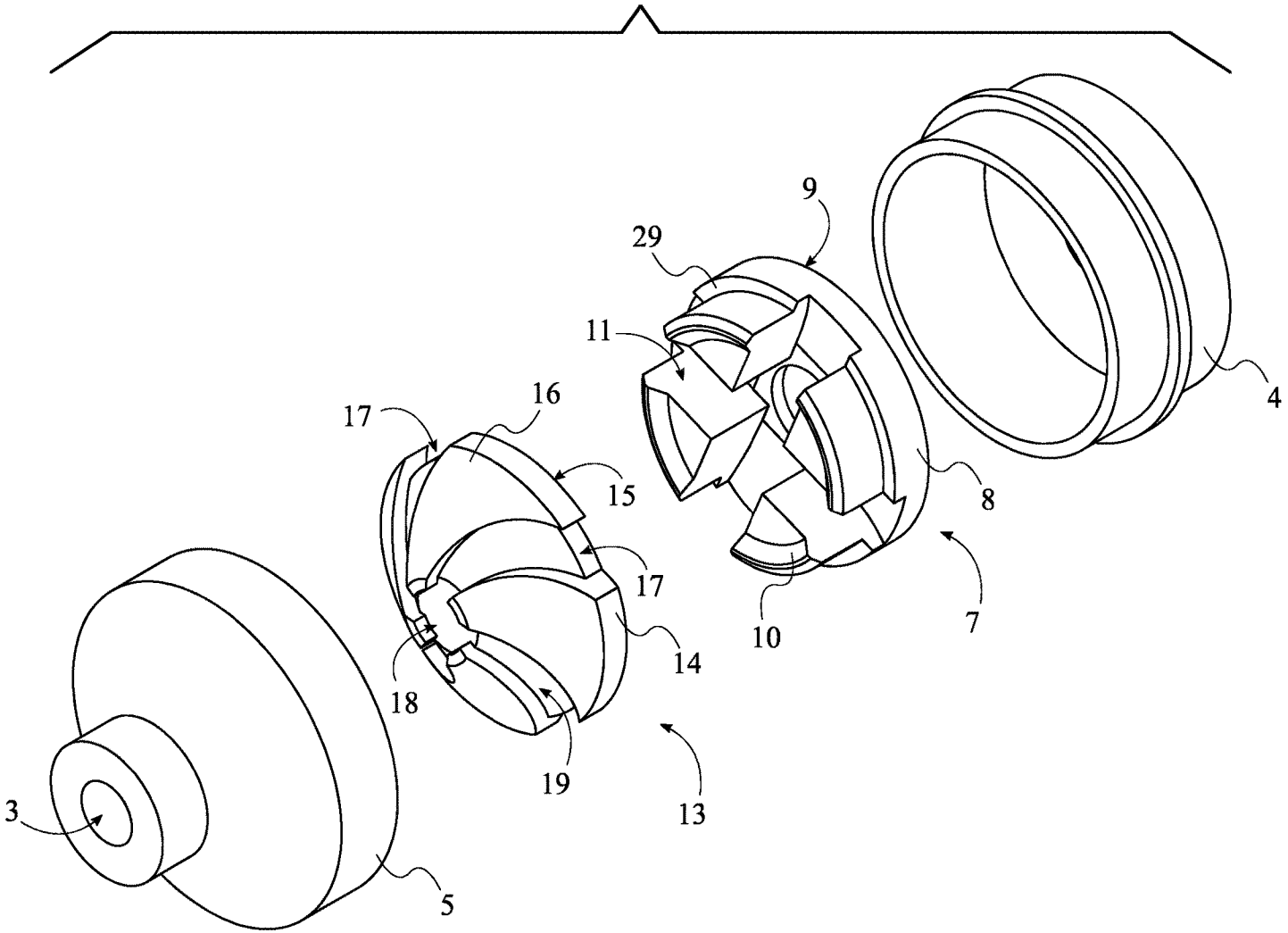
FIG. 3 is a top front-exploded perspective view showing the energy-conserving fluid pump.
Figure 4:
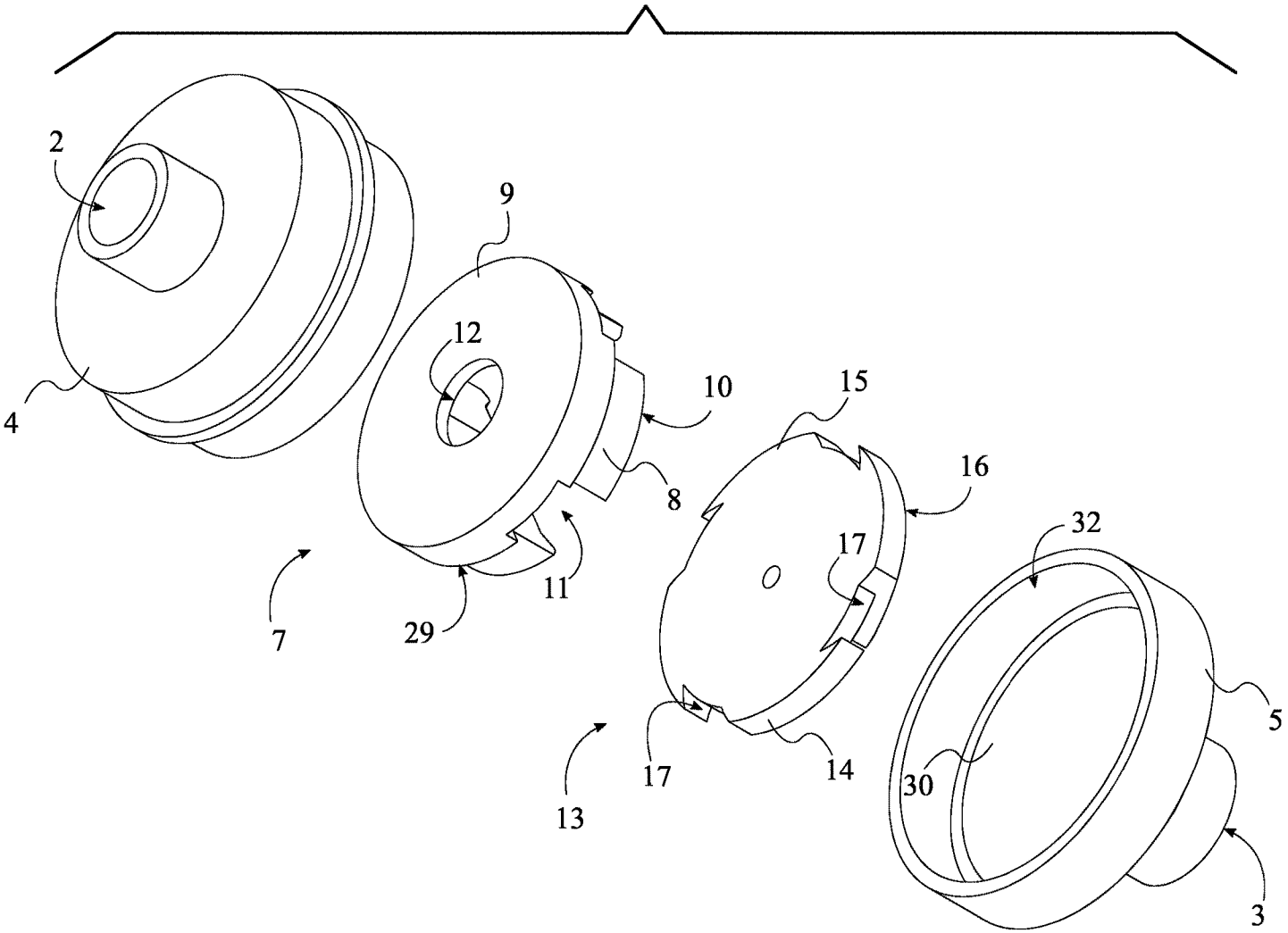
FIG. 4 is a bottom rear-exploded perspective view showing the energy-conserving fluid pump.
Figure 5:
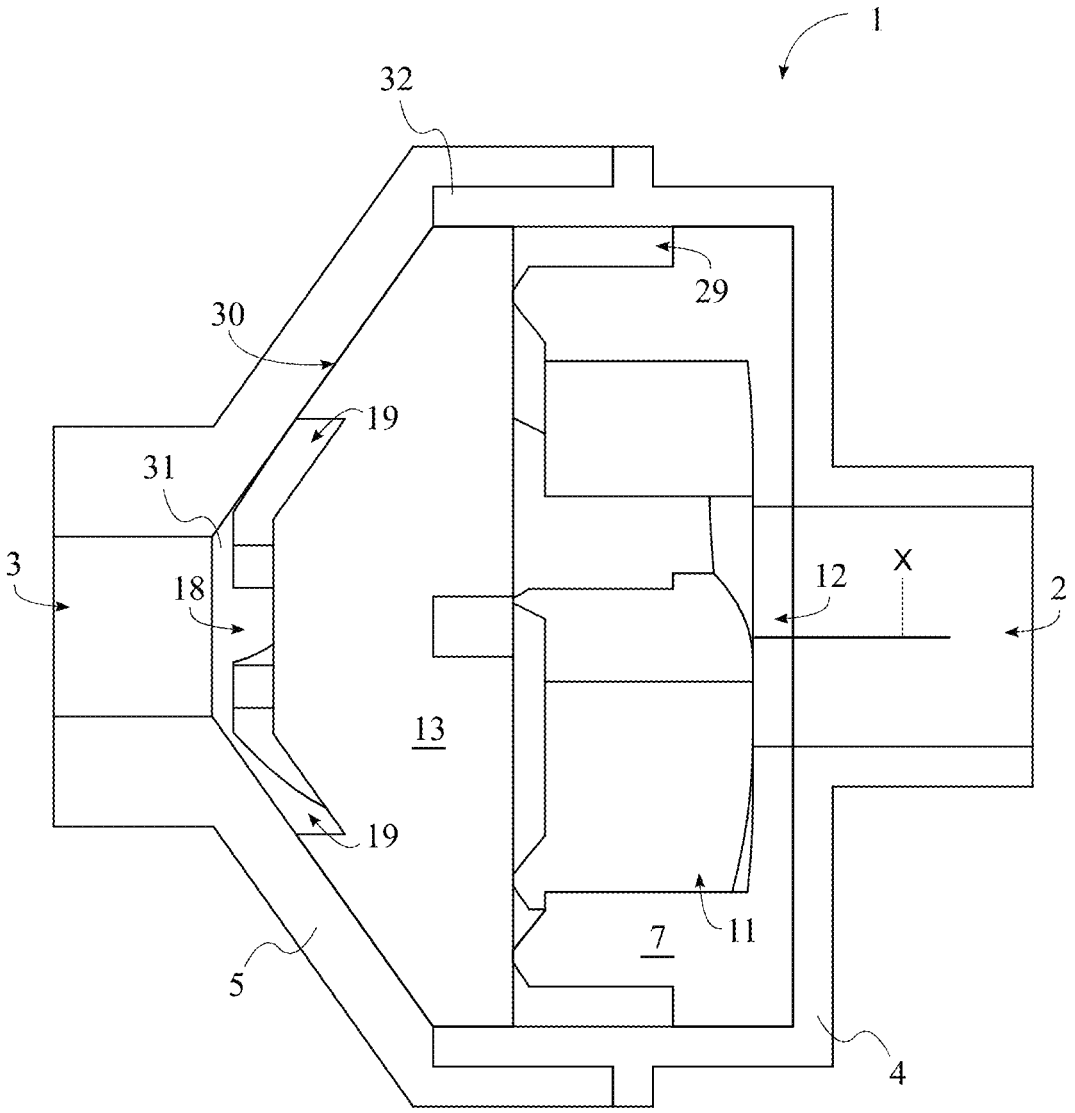
FIG. 5 is a schematic view showing the fluid diffuser and the fluid densifier within the energy-conserving fluid pump.
Figure 6:
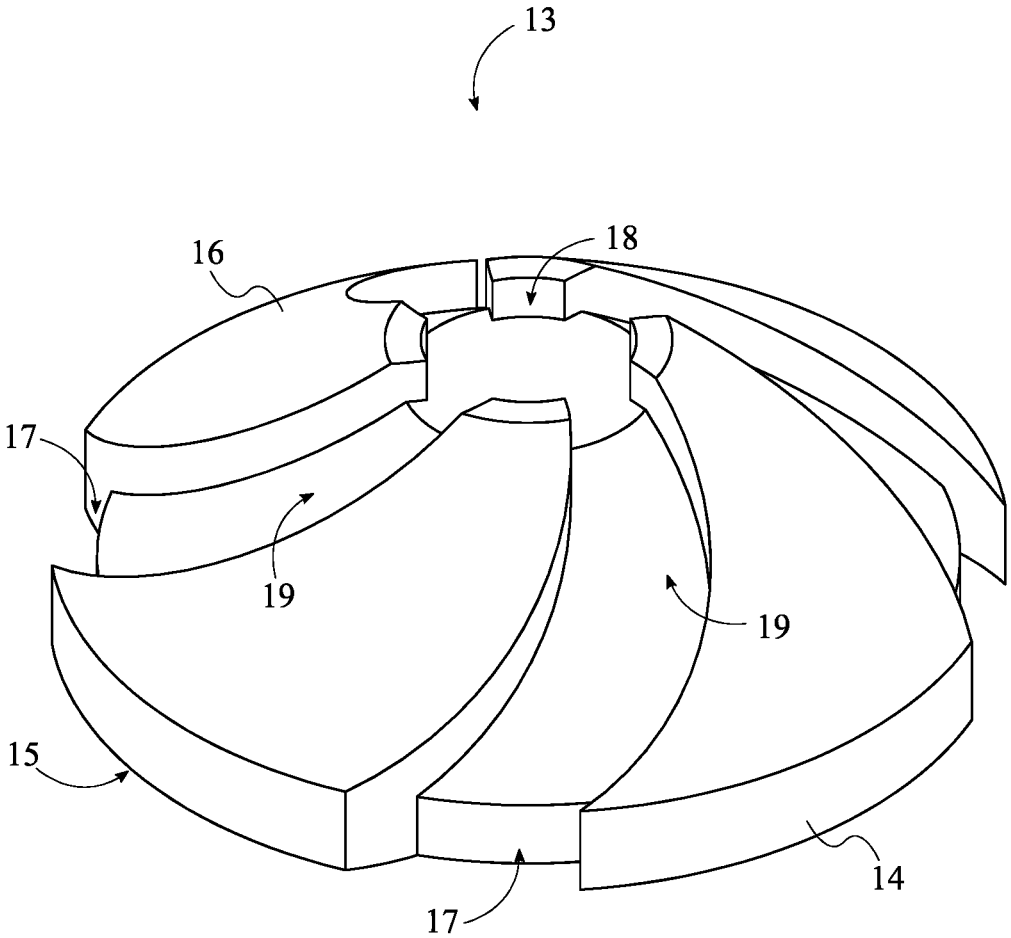
FIG. 6 is a top front perspective view showing the fluid densifier.
Figure 7:
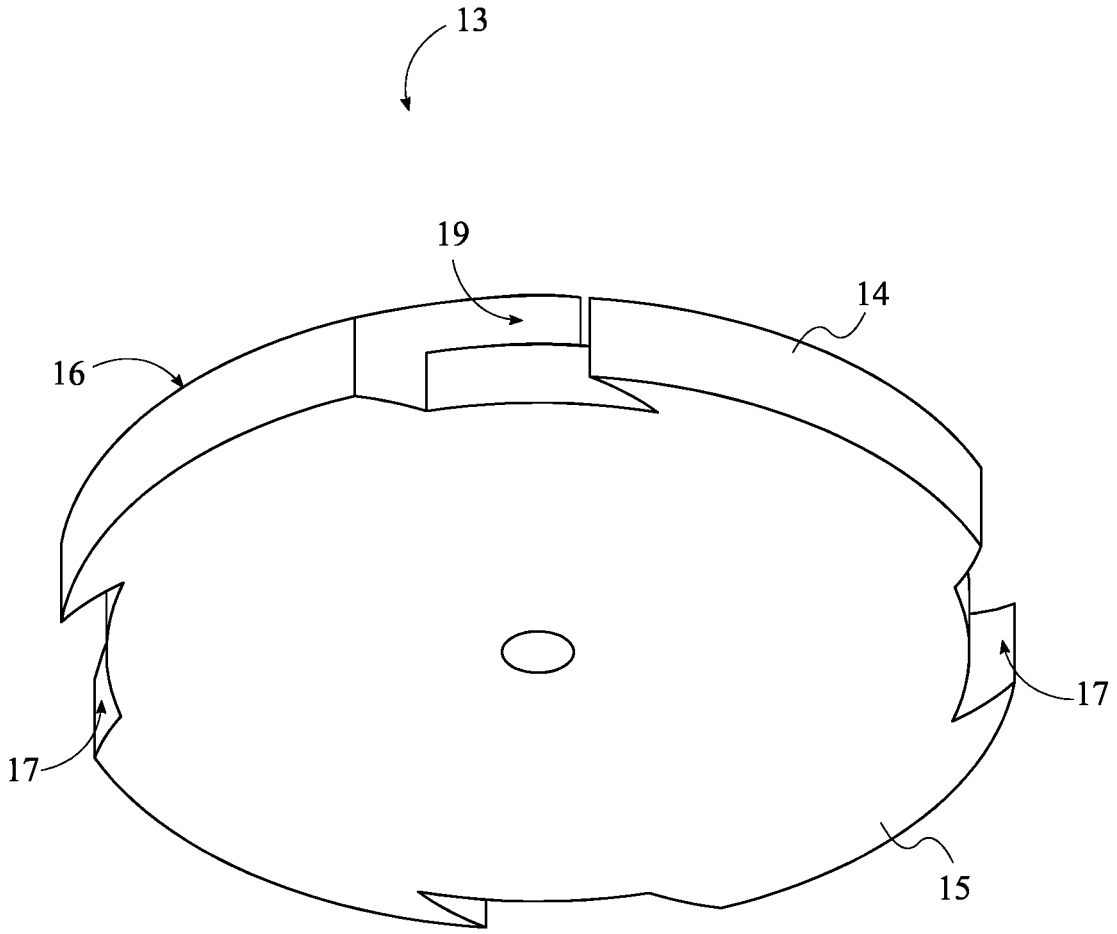
FIG. 7 is a bottom rear perspective view showing the fluid densifier.
Figure 8:
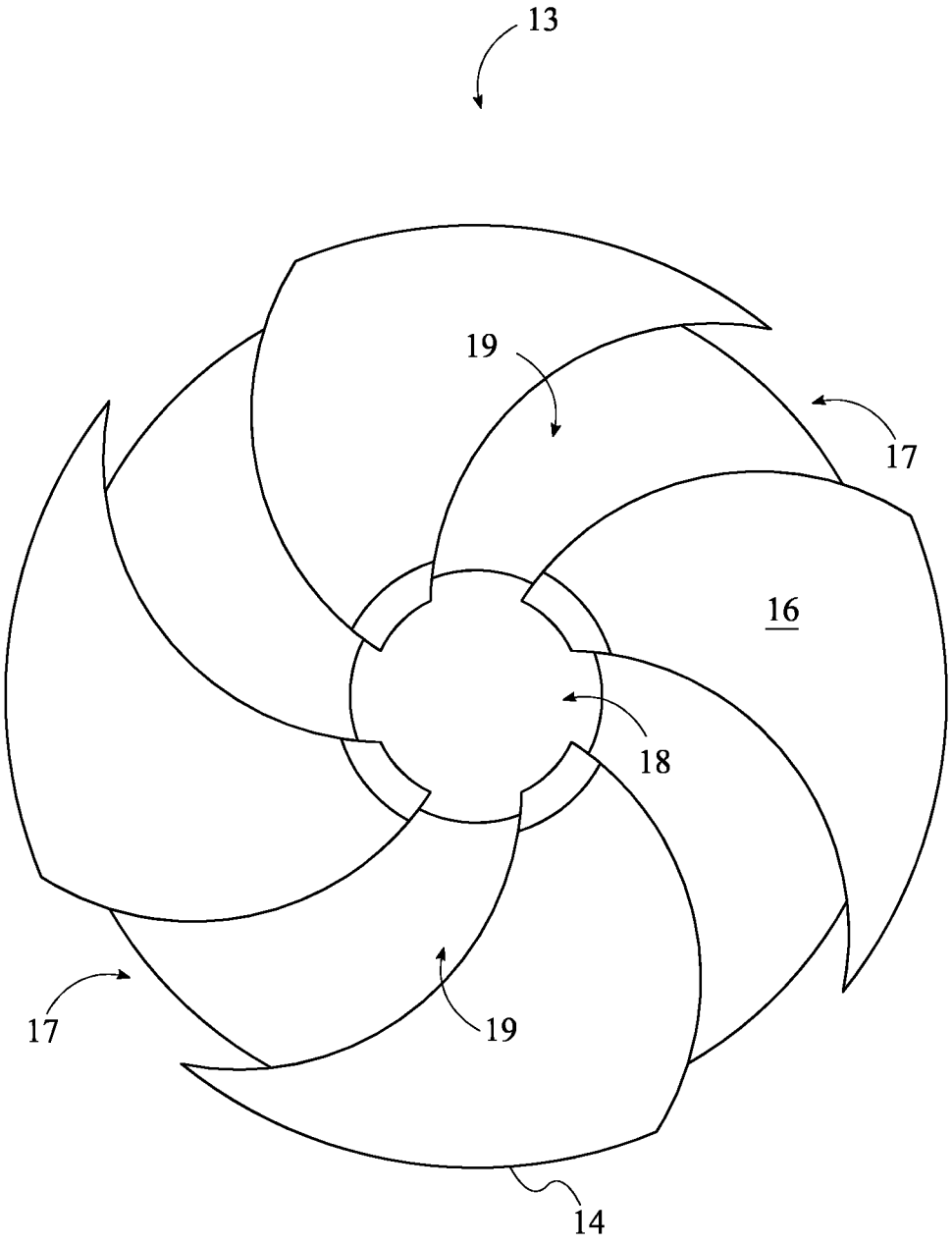
FIG. 8 is a top view showing the fluid densifier.

As can be seen in FIG. 6 through 8, the first densifier face 15 and the second densifier face 16 are positioned opposite to each other about the densifier body 14, forming the disc shape of the densifier body 14. The plurality of densifier inlets 17 traverse from the first densifier face 15, through the densifier body 14, and to the second densifier face 16 to enable the fluid flow through the densifier body 14. The plurality of densifier inlets 17 is peripherally distributed about the densifier body 14 to guide the flowing fluid from the periphery of the densifier body 14 to the center. The densifier outlet 18 and each of the plurality of spiraling channels 19 traverse from the second densifier face 16 into the densifier body 14 to enable the shearing of the flowing fluid. The plurality of spiraling channels 19 are radially positioned about the densifier outlet 18 to shear the fluid flowing through the densifier body 14. Further, the number of plurality of spiraling channels 19 matches the number of plurality of densifier inlets 17. As can be seen in FIG. 3 through 5, the housing inlet 2 is in fluid communication with the plurality of densifier inlets 17 through the fluid diffuser 7 so the flowing fluid is expanded before reaching the fluid densifier 13. As the fluid flows from the rotating fluid diffuser 7 to the stationary fluid densifier 13, the fluid shear takes place and increases as fluid flow decreases. At the same time, fluid pressure and RPMs are increasing without adding load to the system, thus maintaining energy conservation. Each of the plurality of densifier inlets 17 is in fluid communication with the densifier outlet 18 through a corresponding spiraling channel from the plurality of spiraling channels 19 so the sheared fluid can exit the densifier body 14. Further, the densifier outlet 18 is in fluid communication with the housing outlet 3 so the pressurized fluid can exit the convergent housing 1. The densifier outlet 18 is slightly smaller than the plurality of spiraling channels 19 in volume to maintain a high pressure while vectoring the fluid back to the center of the convergent housing 1 and out into an external plumbing system.

Figure 16:
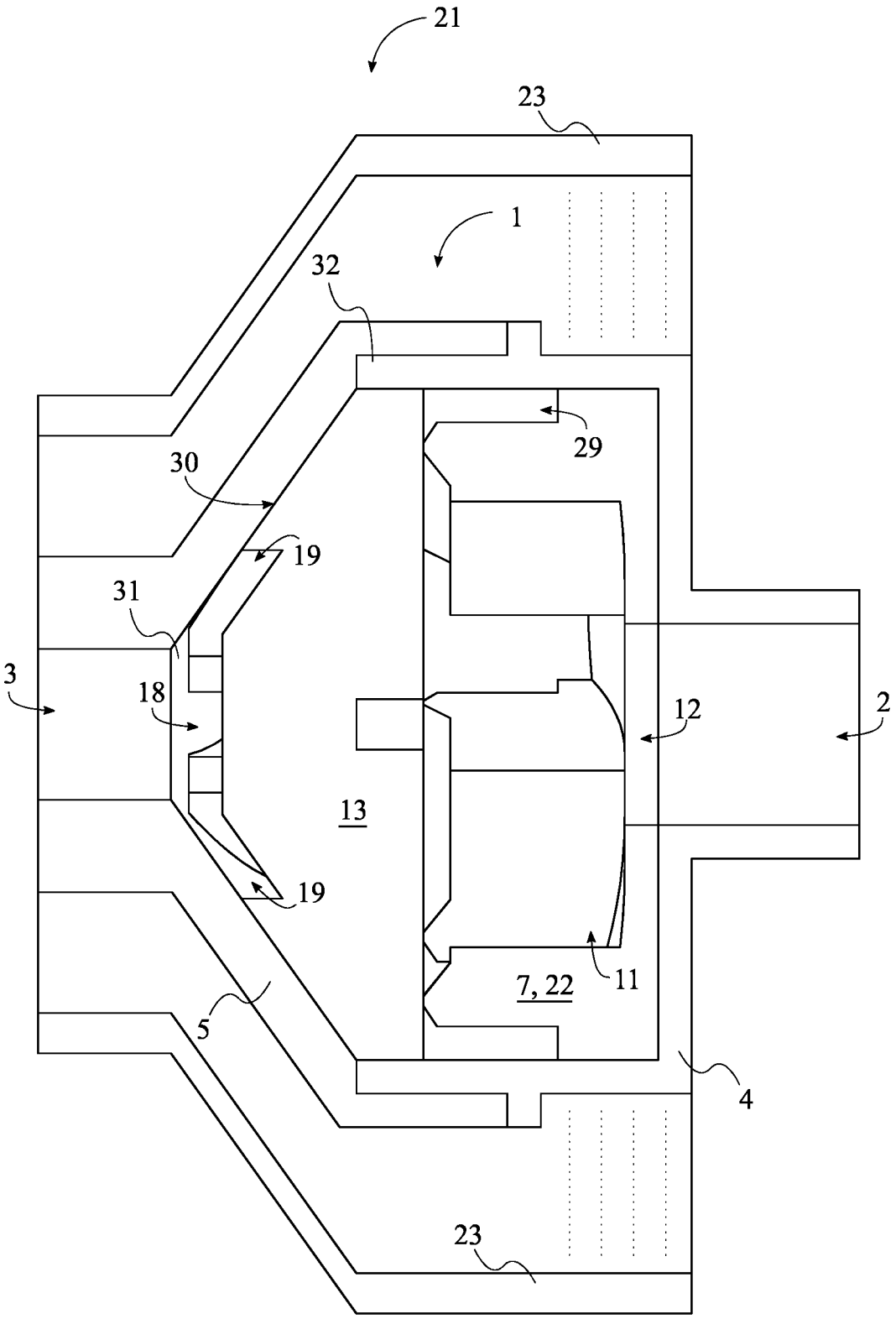
FIG. 16 is a schematic view showing the energy-conserving fluid pump with a magnetic coupling.

To prevent motor locking or similar operational issues present in traditional pumps, the present invention utilizes different methods to drive the rotation of the fluid diffuser 7. The convergent housing 1 and/or the fluid diffuser 7 can be driven by external means or be an integral part of the driving means. In some embodiments, the present invention may further comprise a magnetic coupling 21 which enables the fluid diffuser 7 to be driven by an external electromagnetic motor. As can be seen in FIG. 16, the magnetic coupling 21 comprises a coupling rotor 22 and a coupling stator 23. As previously discussed, the fluid diffuser 7 is rotatably mounted within the convergent housing 1 and the fluid densifier 13 is stationarily mounted within the convergent housing 1. In this embodiment, the fluid diffuser 7 carries coupling rotor 22. On the other hand, the coupling stator 23 is externally mounted onto the convergent housing 1 and the coupling stator 23 is also positioned about the fluid diffuser 7 to connect the present invention to the external electromagnetic motor. Further, the coupling stator 23 is operatively coupled to the coupling rotor 22, wherein the coupling stator 23 is used to magnetically rotate the coupling rotor 22. For example, the magnetic coupling 21 can utilize multiple magnetic devices, such as magnetic bushings, externally connected to the fluid diffuser 7 or the convergent housing 1.

Figure 12:
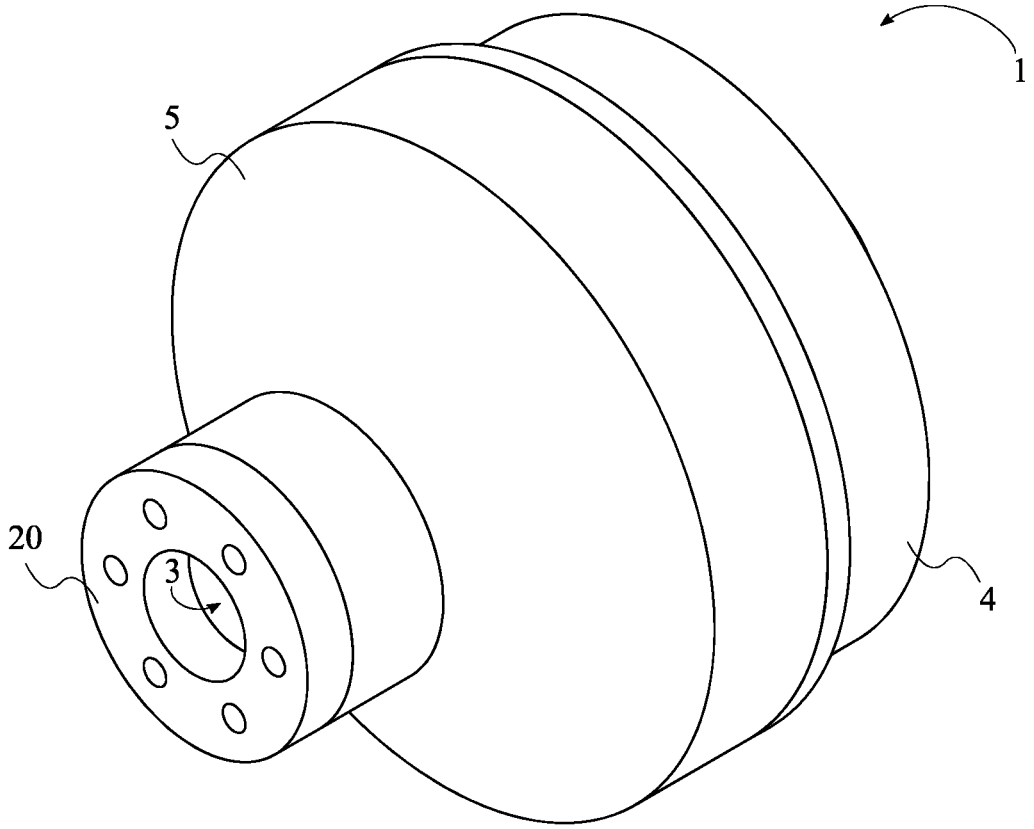
FIG. 12 is a top front perspective view showing the energy-conserving fluid pump with a pump drive coupling.
Figure 13:
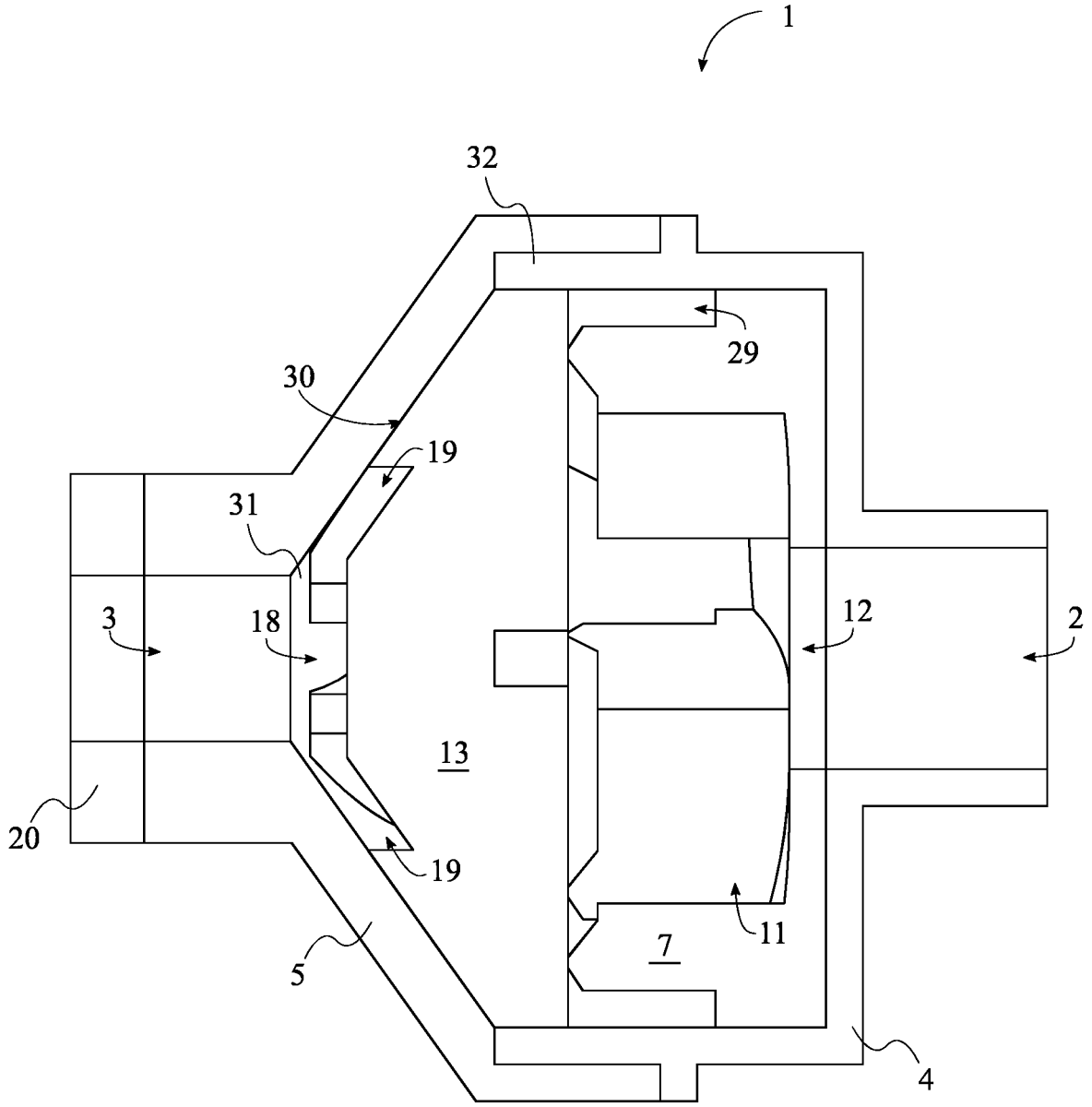
FIG. 13 is a schematic view showing the energy-conserving fluid pump with the pump drive coupling.

In other embodiments, the present invention can utilize external mechanical means to drive the fluid diffuser 7. The external mechanical means can include an external motor or an electric or petroleum fuel engine. As can be seen in FIGS. 12 and 13, the present invention may further comprise a pump drive coupling 20 to rotate the fluid diffuser 7 to the desired RPM. The pump drive coupling 20 can be a cogged belt or gears. Unlike the embodiment with the magnetic coupling 21, the fluid diffuser 7 is stationarily mounted within the convergent housing 1 so the convergent housing 1 rotates along with the fluid diffuser 7. On the other hand, the fluid densifier 13 is mounted within the convergent housing 1 so the fluid densifier 13 does not rotate along with the convergent housing 1. The pump drive coupling 20 is positioned about the housing outlet 3. In addition, the pump drive coupling 20 is torsionally and externally connected to the convergent housing 1 to transmit the torque from an external source to the convergent housing 1. Thus, as the convergent housing 1 rotates, the fluid diffuser 7 rotates but the fluid densifier 13 stays stationary.

Figure 14:
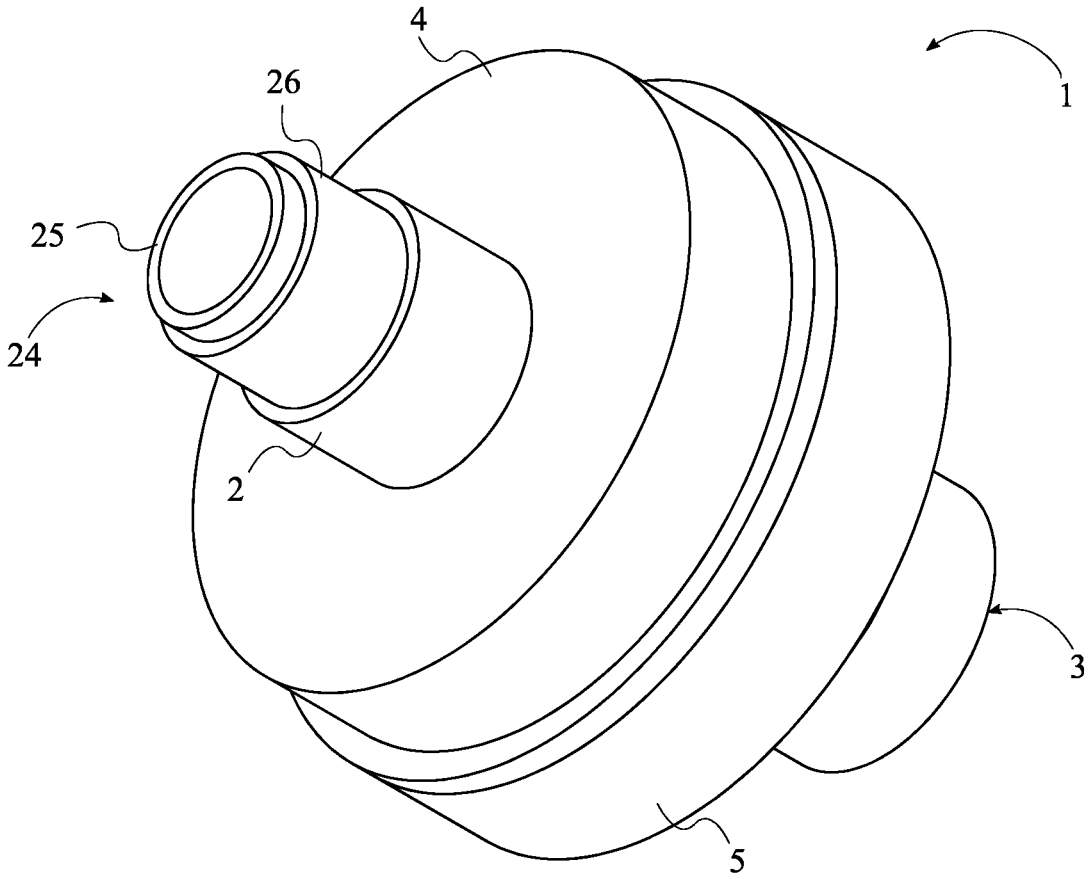
FIG. 14 is a bottom rear perspective view showing the energy-conserving fluid pump connected to an electric motor.
Figure 15:
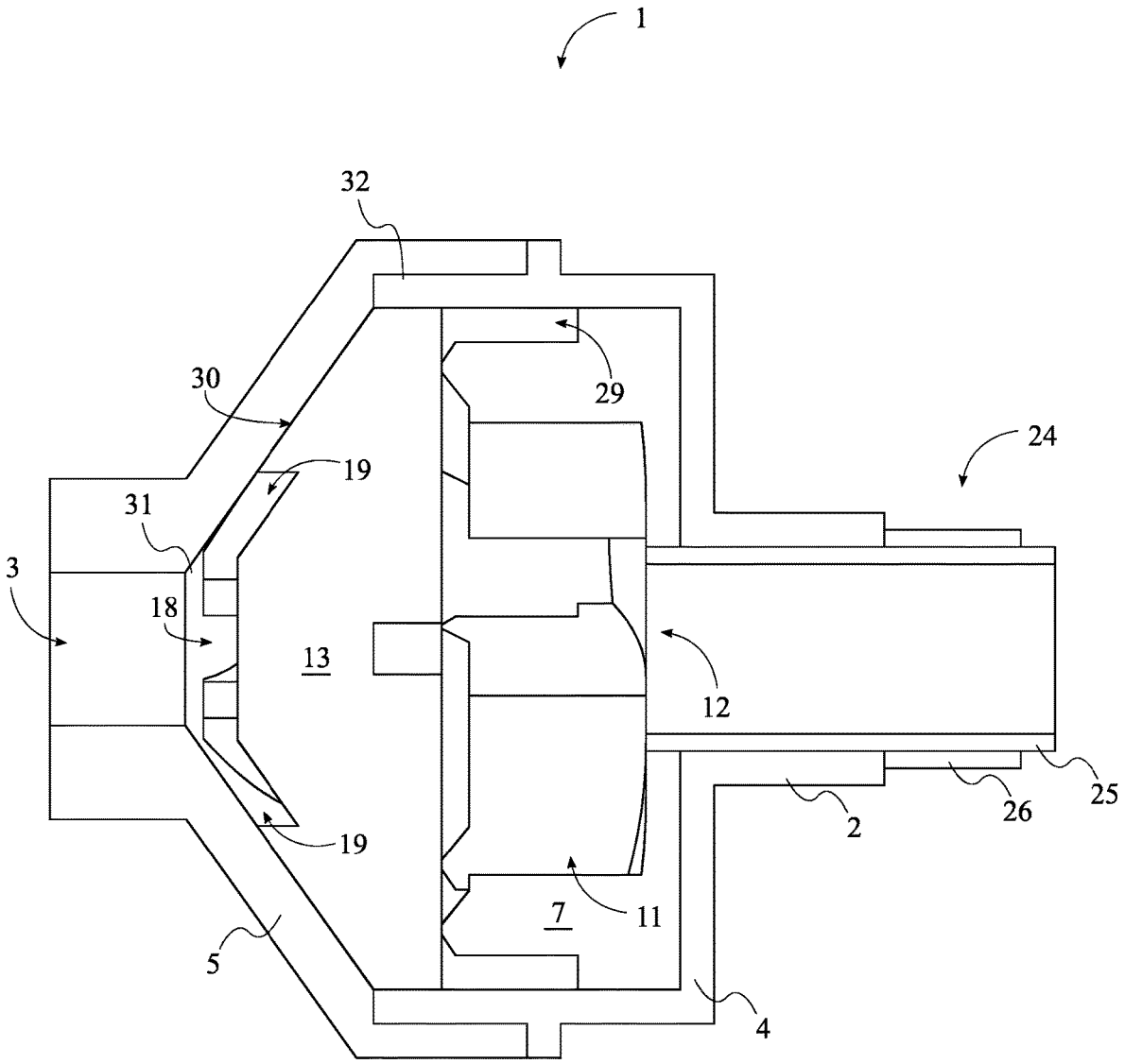
FIG. 15 is a schematic view showing the energy-conserving fluid pump connected to the electric motor.

Furthermore, the present invention can utilize integrated mechanical means to rotate the fluid diffuser 7 within the convergent housing 1. As can be seen in FIGS. 14 and 15, the present invention may further comprise an electric motor 24. The electric motor 24 comprises a motor rotor 25 and a motor stator 26. Like the embodiment with the magnetic coupling 21, the fluid diffuser 7 is rotatably mounted within the convergent housing 1 and the fluid densifier 13 is stationarily mounted within the convergent housing 1. The electric motor 24 is also positioned within the convergent housing 1 so the electric motor 24 can be connected to the fluid diffuser 7. The motor stator 26 is stationarily connected to the convergent housing 1 and the motor rotor 25 is torsionally connected to the fluid diffuser 7. Thus, when the electric motor 24 is engaged, the motor rotor 25 will rotate about the motor stator 26, causing the fluid diffuser 7 to rotate to the desired RPM. In other embodiments, the present invention can utilize other drive means to rotate the convergent housing 1 and/or the fluid diffuser 7 to the desired RPM.

Figure 9:
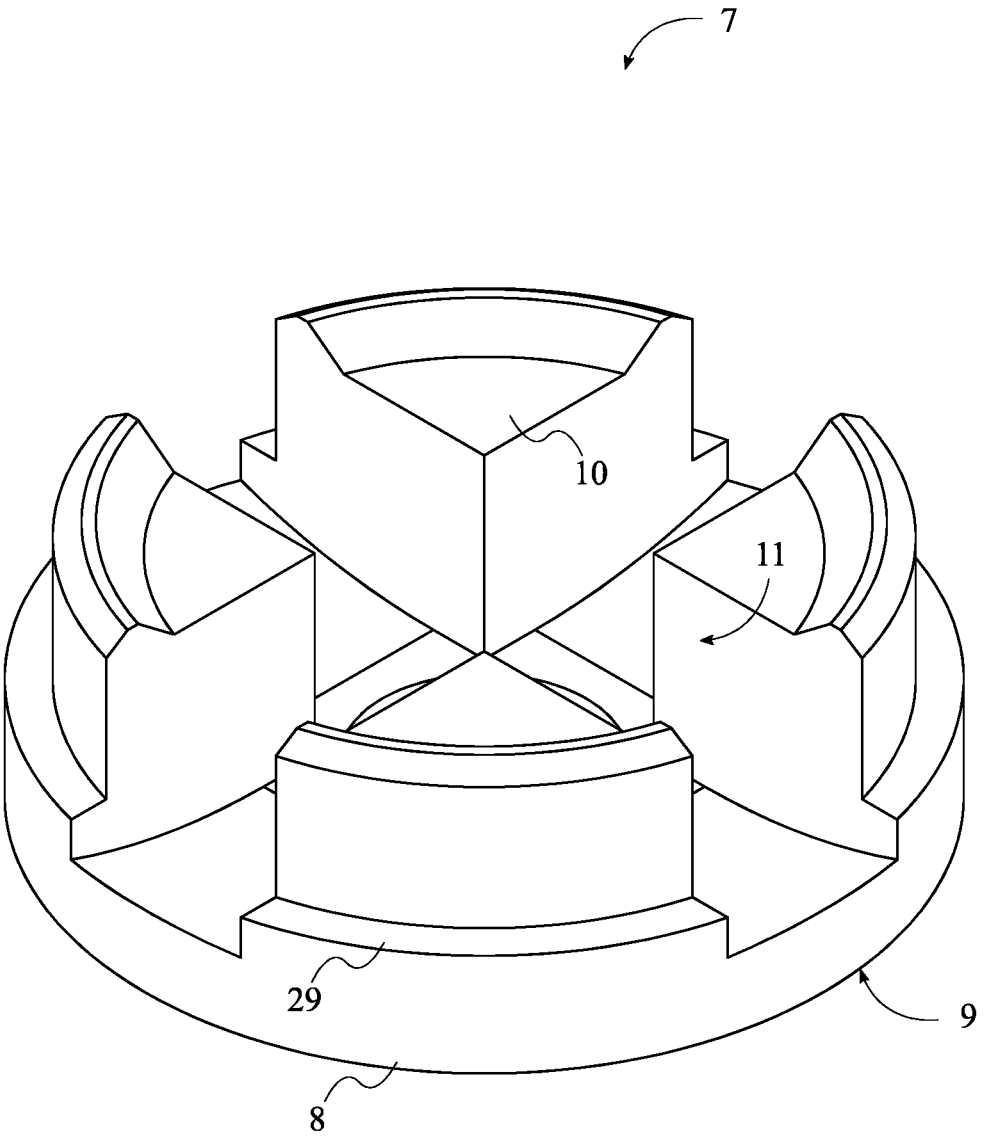
FIG. 9 is a top front perspective view showing the fluid diffuser.
Figure 10:
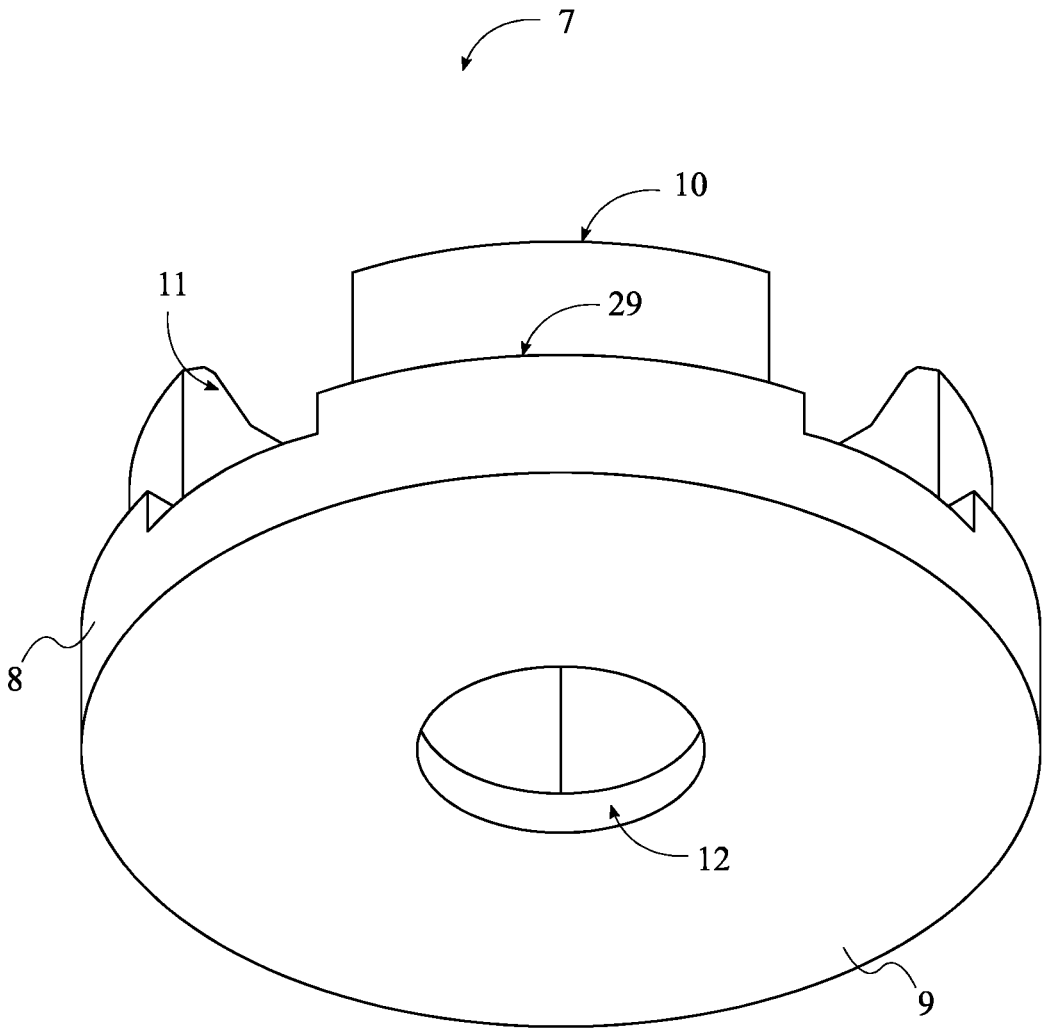
FIG. 10 is a bottom rear perspective view showing the fluid diffuser.
Figure 11:
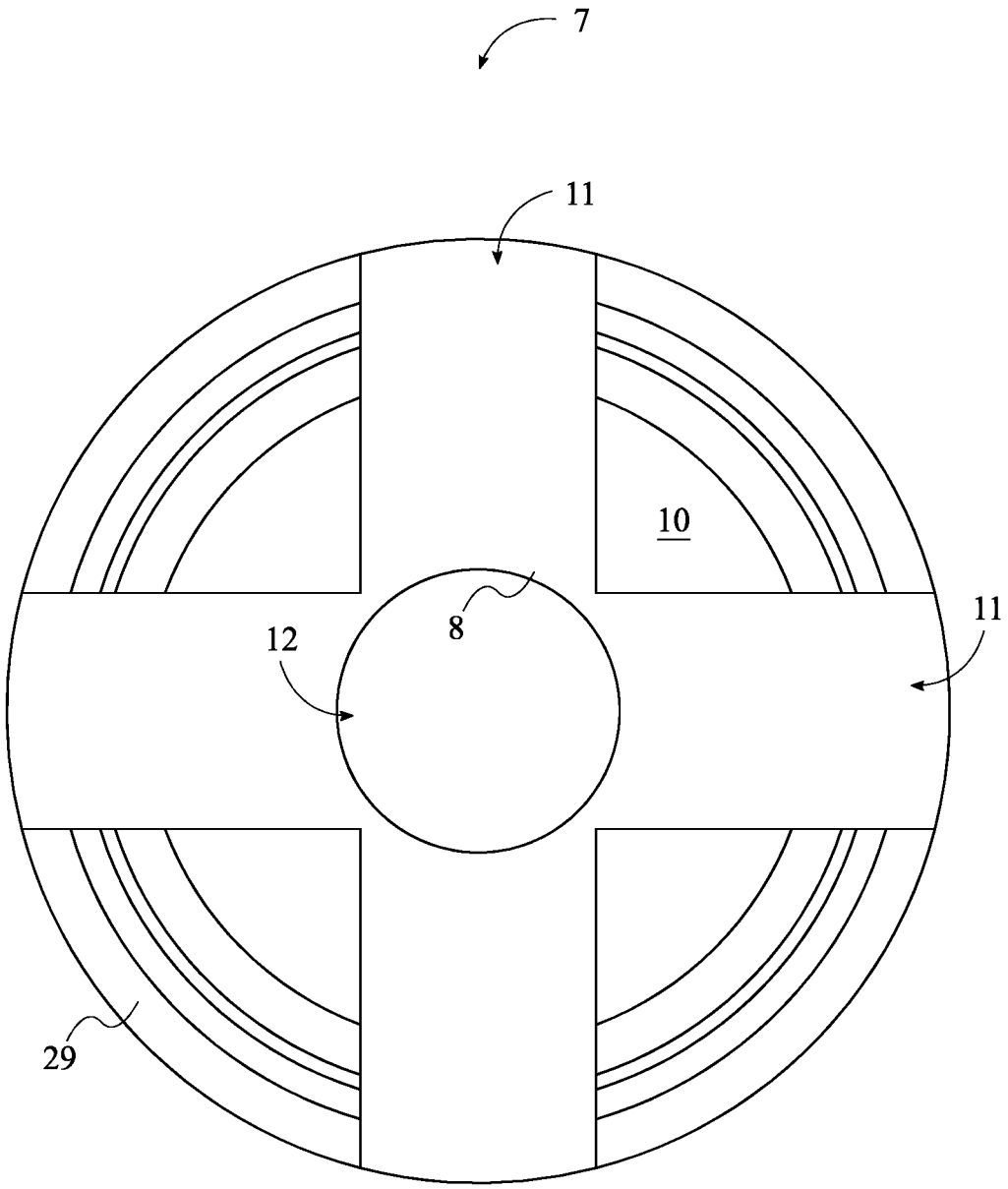
FIG. 11 is a top view showing the fluid diffuser.

To increase the efficiency of the fluid diffuser 7, the fluid diffuser 7 is designed to greatly increase the pressure of the flowing fluid. As can be seen in FIG. 9 through 11, the fluid diffuser 7 may comprise a diffuser body 8, one or more diffuser channels 11, and a fluid-receiving hole 12. In addition, the diffuser body 8 comprises a first diffuser face 9 and a second diffuser face 10. The first diffuser face 9 and the second diffuser face 10 are positioned opposite to each other about the diffuser body 8 to form the disc shape of the diffuser body 8. The fluid-receiving hole 12 axially traverses from the first diffuser face 9, through the diffuser body 8, and to the second diffuser face 10 to guide the fluid flow through the diffuser body 8. The one or more diffuser channels 11 traverse from the second diffuser face 10 into the diffuser body 8 to guide the fluid flow towards the fluid densifier 13. In addition, the one or more diffuser channels 11 are radially positioned about the fluid-receiving hole 12 to match the arrangement of the plurality of densifier inlets 17. The one or more diffuser channels 11 reduce in size outwardly to constantly build up pressure. As can be seen in FIG. 9, the cross-sectional area of the one or more diffuser channels 11 contracts along the length, with the cross-sectional area being the largest close to the fluid-receiving hole 12 and the smallest close to the periphery of the diffuser body 8. Further, the housing inlet 2 is in fluid communication with the fluid-receiving hole 12. Also, the fluid-receiving hole 12 is in fluid communication with the one or more diffuser channels 11. Thus, the fluid inflow is guided towards the one or more diffuser channels 11. Finally, each of the one or more diffuser channels 11 is in fluid communication with the plurality of densifier inlets 17 so the expanded fluid flows into the fluid densifier 13.

In addition, to keep the fluid flowing through the present invention without sloshing, the fluid diffuser 7 may further comprise an annular channel 29. As can be seen in FIGS. 5, 9, and 11, the annular channel 29 traverses from the second diffuser face 10 into the diffuser body 8 so that the annular channel 29 is part of the diffuser body 8 without interrupting the rotation of the diffuser body 8. The annular channel 29 is concentrically positioned around the fluid-receiving hole 12 and the annular channel 29 is peripherally positioned on the second diffuser face 10. Further, the annular channel 29 is intersected by each of the one or more diffuser channels 11. Thus, as can be seen in FIG. 5, as the diffuser body 8 keeps rotating, the expanded fluid keeps flowing from the one or more diffuser channels 11 into the plurality of densifier inlets 17.

To maintain the convergent housing 1 fully sealed to prevent fluid sloshing, the convergent housing 1 is designed to snug fit around the fluid diffuser 7 and the fluid densifier 13 without rotating the fluid densifier 13. As can be seen in FIG. 1 through 4, the convergent housing 1 may further comprise a first housing section 4 and a second housing section 5 to accommodate the fluid diffuser 7 and the fluid densifier 13 individually. The housing inlet 2 is integrated into the first housing section 4, while the housing outlet 3 is integrated into the second housing section 5. The first housing section 4 and the second housing section 5 are positioned opposite to each other about the convergent housing 1 to coincide with the fluid diffuser 7 and the fluid densifier 13. Thus, the fluid diffuser 7 is positioned within the first housing section 4 while the fluid densifier 13 is positioned within the second housing section 5.

To further prevent the loss of energy, the second housing section 5 may comprise a conical interior surface 30. As can be seen in FIGS. 4 and 5, the conical interior surface 30 comprises a narrow portion 31 and a wider portion 32 to form the conical shape. The narrow portion 31 is positioned adjacent to the housing outlet 3, while the wide portion 32 is positioned adjacent to the fluid diffuser 7 to accommodate the diffuser body 8. In addition, the densifier body 14 tapers from the first densifier face 15 to the second densifier face 16 so that the densifier body 14 fits within the second housing section 5. Thus, the conical interior surface 30 is positioned coextensive to the densifier body 14. When the fluid leaves the densifier outlet 18, the fluid enters the smooth open second housing section 5 with no traction, no vanes, and no captive sections. Thus, the fluid slips through and is directed back to the center of the second housing section 5, eliminating any centrifugal force to be reapplied to the flowing fluid. In other embodiments, the second housing section 5 may comprise non-conical interior surfaces matching different shapes of the densifier body 14.

Figure 17:
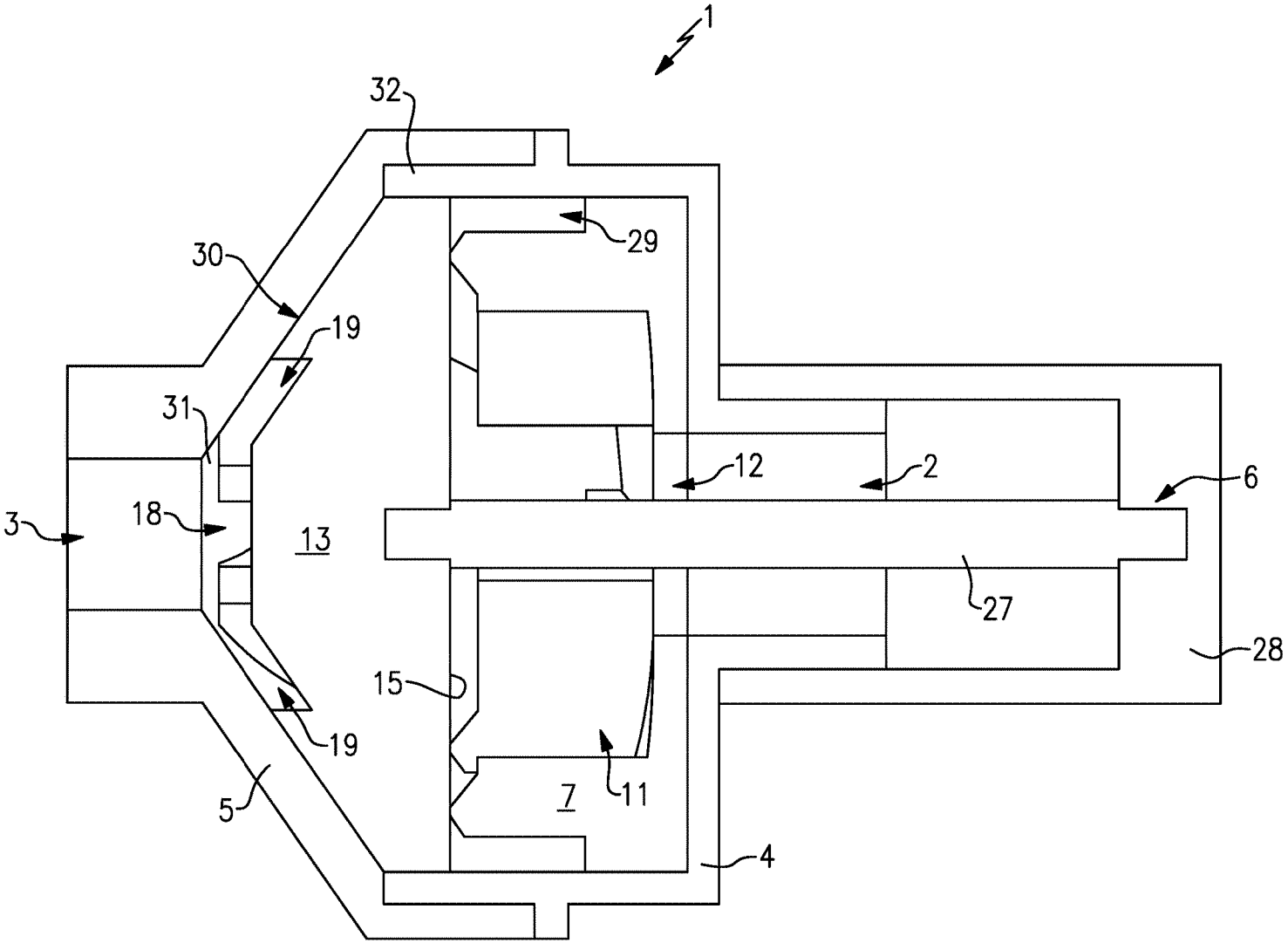
FIG. 17 is a schematic view showing the energy-conserving fluid pump with a strut assembly.

Finally, to maintain the fluid densifier 13 stationary within the convergent housing 1, the present invention may comprise a strut assembly 6. As can be seen in FIG. 17, the strut assembly 6 is positioned through the housing inlet 2, into the convergent housing 1, through the fluid-receiving hole 12 of the fluid diffuser 7, and to the first densifier face 15 to not obstruct with the rotation of the fluid diffuser 7. The fluid densifier 13 is terminally connected to the strut assembly 6 so that the strut assembly 6 supports the fluid densifier 13. Further, the strut assembly 6 is positioned normal to the first densifier face 15 and the strut assembly 6 is also axially positioned on the first densifier face 15 so that the convergent housing 1 may rotate while keeping the fluid densifier 13 stationary. With the primary system load being applied on the fluid densifier 13 and absorbed by the strut assembly 6, not by the rotating components, the present invention is able to maintain energy conservation on the flowing fluid. In some embodiments, the strut assembly 6 may comprise a torsion strut 27 and a strut shaft support 28. The strut shaft support 28 is positioned about the housing inlet 2. The strut shaft support 28 is also rotatably and externally connected to the convergent housing 1 so the convergent housing 1 can rotate independent of the strut shaft support 28. The torsion strut 27 is connected in between the first densifier face 15 and the strut shaft support 28 to keep the densifier body 14 stationary by resisting any load on the densifier body 14 that may cause torsion or translation of the densifier body 14 within the convergent housing 1. In other embodiments, the present invention may utilize different mechanisms to keep the fluid densifier 13 stationary within the convergent housing 1.

Figure 18A:
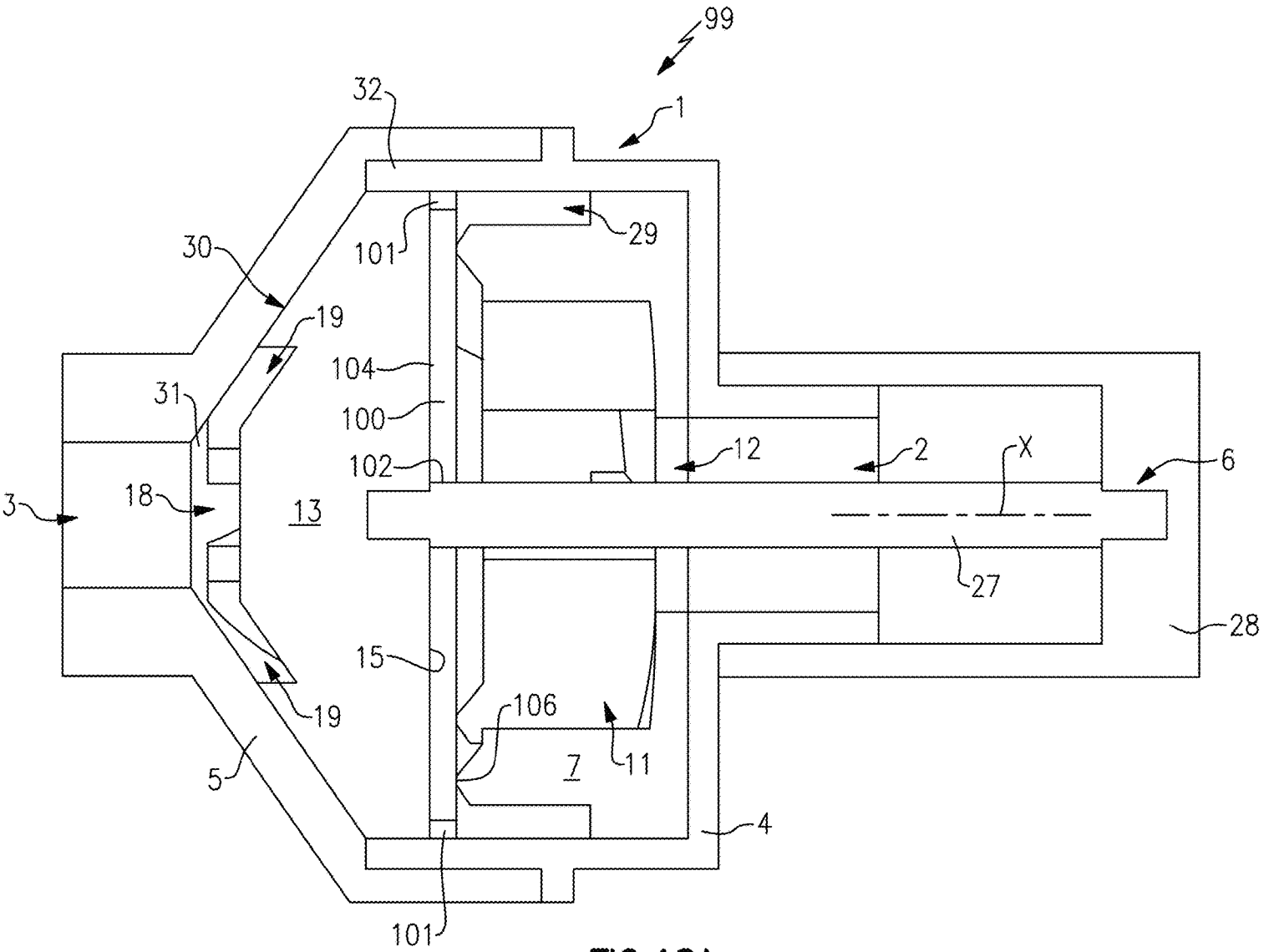
FIG. 18A shows another embodiment having an additional rotating portion.

FIG. 18A shows another pump embodiment 99. Elements that are similar to the earlier embodiments are still identified with the same reference numeral.

A force plate 100 is fixed to the convergent housing 1, and/or diffuser 7 for rotation. The force plate 100 is positioned between the diffuser 7 and the fluid densifier 13. Openings 101 in the force plate 100 communicate with fluid from the channels 29. As shown in FIG. 18A the force plate 100 is simplified, but it has ramps in a forward face 104 that receive fluid from the channel 29 and direct the fluid to the fluid densifier 13 inlets 17. The force plate 100 further has a rear face 106.

Figure 18B:
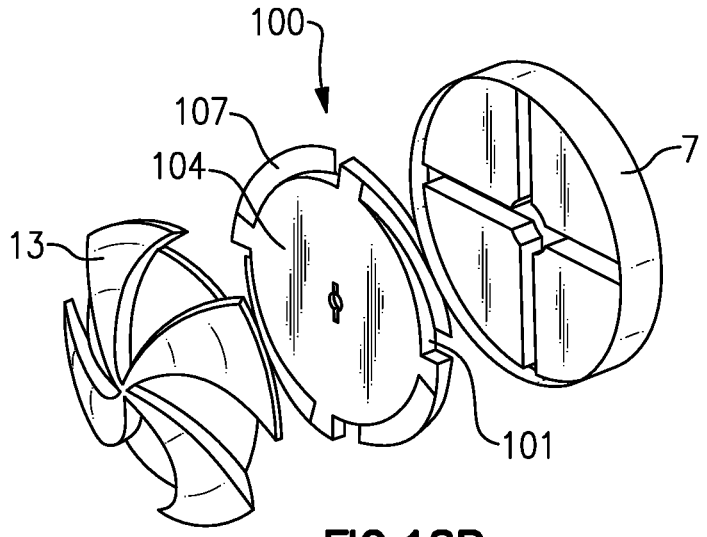
FIG. 18B is an exploded view of three components of the pump.

As shown in FIG. 18B, the ramps 107 are formed into the forward face 100 of the forward face 104 of the force plate 100.

Figure 19A:
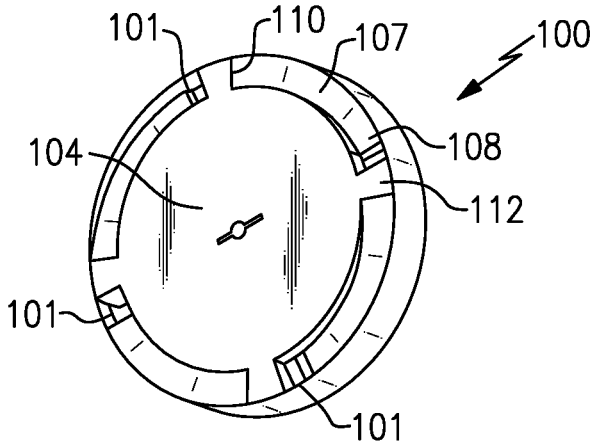
FIG. 19A shows a force plate in perspective.

As shown in FIG. 19A, the openings 101 receive the fluid downstream of the diffuser 7, and pass the fluid along the ramps 107 from an inlet end 108 to an outlet end 110. As can be appreciated from this Figure, the ramps 107 move circumferentially from inlet end 108 to outlet end 110, and with a component extending in an axial direction toward the fluid densifier 13. Further, ramp-free portions 112 are circumferentially interspersed between the ramps 107. In embodiments, there are an equal number of ramps 107 on the force plate 100, diffuser channels on the diffuser 7 and fluid densifier channels on the fluid densifier. While four ramps 107, and by implication four channels are illustrated, utilizing fewer channels, or even a distinct number of ramps 107 than the number of channels in the diffuser and fluid densifier can result in increased pressure from the force plate.

Figure 19B:
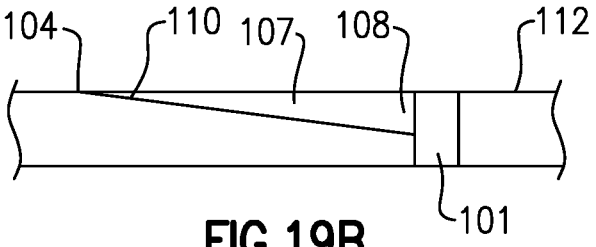
FIG. 19B schematically shows a feature of the FIG. 19A force plate.

As shown schematically in FIG. 19B, the ramp extends in a direction from the inlet end 108 to the outlet end 110 and with a component in an axial direction toward the fluid densifier 13. This increases the pressure of the liquid downstream of the diffuser 7. Axial and radial are relative to a rotational axis X (FIG. 18A).

A fluid pump under this disclosure could be said to include a housing. The housing encloses a fluid diffuser and a fluid densifier. The fluid diffuser and the housing rotate together. The fluid densifier is fixed against rotation. The fluid diffuser has a central opening adapted to be connected to a source of a liquid. The central opening extends through a rear face of the fluid diffuser and opens into a forward face. The forward face of the fluid diffuser has a plurality of diffuser channels extending radially outwardly. The densifier has a rear face facing the fluid diffuser and a forward face facing away from the fluid diffuser. The fluid diffuser has inlets at a radially outward location, with the term radially defined relative to a rotational axis of the fluid diffuser and housing. The fluid densifier inlets communicate with a plurality of fluid densifier channels on the forward face of the fluid densifier. The plurality of fluid densifier channels extends to communicate with an outlet through the housing. A drive rotates the fluid diffuser and the housing relative to the fluid densifier.

A fluid pump under this disclosure could also be said to include a housing. The housing encloses a fluid diffuser and a fluid densifier. The fluid diffuser and the housing rotate together. The fluid densifier is fixed against rotation. The fluid diffuser has an opening adapted to be connected to a source of a liquid, and opening into a forward face. The forward face of the fluid diffuser has a plurality of diffuser channels extending radially outwardly. The densifier has a rear face facing the fluid diffuser and a forward face facing away from the fluid diffuser. The fluid diffuser has inlets at a radially outward location, with the term radially defined relative to a rotational axis of the fluid diffuser and housing. The fluid densifier inlets communicate with a plurality of fluid densifier channels on the forward face of the fluid densifier, and the plurality of fluid densifier channels extend to communicate with an outlet through the housing. A force plate is positioned axially between the fluid diffuser and the fluid densifier. The force plate has openings that communicate with the fluid diffuser channels. The force plate openings connect to communicate liquid received from the diffuser channels along ramps that decrease in cross-sectional area in a downstream direction.

Although the invention has been explained in relation to its preferred embodiment, it is to be understood that many other possible modifications and variations can be made without departing from the spirit and scope of the invention as hereinafter claimed.

What is claimed is:

1. A fluid pump comprising:

a housing, said housing enclosing a fluid diffuser and a fluid densifier, said fluid diffuser and said housing rotating together, said fluid densifier being fixed against rotation;

the fluid diffuser having a central opening adapted to be connected to a source of a liquid, the central opening extending through a rear face of the fluid diffuser and opening into a forward face, said forward face of said fluid diffuser having a plurality of diffuser channels extending radially outwardly;

said fluid densifier having a rear face facing said fluid diffuser and a forward face facing away from said fluid diffuser, said fluid densifier having inlets at a radially outward location, with the term radially defined relative to a rotational axis of the fluid diffuser and the housing, and said fluid densifier inlets communicating with a plurality of fluid densifier channels on the forward face of the fluid densifier, and said plurality of fluid densifier channels extending to communicate with an outlet through the housing; and a drive for rotating the fluid diffuser and the housing relative to the fluid densifier.

2. The pump as set forth in claim 1, wherein the fluid diffuser channels communicate with a radially outward channel, and said fluid densifier inlets communicating with said radially outward channel.

3. The pump as set forth in claim 1, wherein the drive includes a magnetic coupling with a rotor connected to drive the fluid diffuser and housing, and a stator that is static and outward of the housing.

4. The pump as set forth in claim 1, wherein the drive is a pump drive coupling from a drive member outwardly of the housing.

5. The pump as set forth in claim 1, wherein an electric motor drives a shaft to in turn drive the fluid diffuser and housing as the drive.

6. The pump as set forth in claim 1, wherein each of the fluid densifier channels extend along a spiral from the corresponding fluid densifier inlet to a fluid densifier outlet at a radially inward location relative to the fluid densifier inlets.

7. The pump as set forth in claim 1, wherein a strut assembly fixes the fluid densifier relative to the fluid diffuser and housing.

8. The pump as set forth in claim 7, wherein the strut assembly comprises a strut that is connected to a static structure outwardly of the rotating housing.

9. The pump as set forth in claim 8, wherein the strut extends through the central opening, and beyond the diffuser rear face to be connected to the static structure.

10. The pump as set forth in claim 1, wherein a force plate is positioned axially between the fluid diffuser and the fluid densifier, and the force plate having openings that communicate with the fluid diffuser channels, and the force plate openings connected to communicate liquid received from the diffuser channels along ramps extending circumferentially and with a component in an axial direction toward the fluid densifier, the ramps connected to communicate liquid to the fluid densifier inlets.

11. A fluid pump comprising:

a housing enclosing a fluid diffuser and a fluid densifier, said fluid diffuser and said housing rotating together, said fluid densifier being fixed against rotation;

the fluid diffuser having an opening adapted to be connected to a source of a liquid, and opening into a forward face, said forward face of said fluid diffuser having a plurality of diffuser channels extending radially outwardly;

said fluid densifier having a rear face facing said fluid diffuser and a forward face facing away from said fluid diffuser, said fluid densifier having inlets at a radially outward location, with the term radially defined relative to a rotational axis of the fluid diffuser and the housing, and said fluid densifier inlets communicating with a plurality of fluid densifier channels on the forward face of the fluid densifier, and said plurality of fluid densifier channels extending to communicate with an outlet through the housing; and a force plate positioned axially between the fluid diffuser and the fluid densifier, and the force plate having openings that communicate with the fluid diffuser channels, and the force plate openings connected to communicate liquid received from the diffuser channels along ramps that decrease in cross-sectional area in a downstream direction.

12. The pump as set forth in claim 11, wherein there is a magnetic coupling with a rotor connected to drive the fluid diffuser and housing, and a stator that is static and outward of the housing.

13. The pump as set forth in claim 11, wherein a pump drive coupling extending from a drive member outwardly of the housing.

14. The pump as set forth in claim 11, wherein an electric motor drives a shaft to in turn drive the fluid diffuser, the force plate and housing.

15. The pump as set forth in claim 11, wherein each of the fluid densifier channels extend along a spiral from the corresponding fluid densifier inlet to a fluid densifier outlet at a radially inward location relative to the fluid densifier inlets.

16. The pump as set forth in claim 11, wherein a strut assembly fixes the fluid densifier relative to the fluid diffuser and housing.

17. The pump as set forth in claim 16, wherein the strut assembly comprises a strut extending through the central opening, and beyond the diffuser rear face to be connected to a static structure.

18. The pump as set forth in claim 11, wherein the ramps extending circumferentially and with a component in an axial direction toward the fluid densifier to result in the decrease in cross-sectional area, the ramps connected to communicate liquid to the fluid densifier inlets.

19. The pump as set forth in claim 11, wherein there are equal numbers of the diffuser channels, force plate ramps and fluid densifier channels.

20. The pump as set forth in claim 11, wherein there are unequal numbers of the diffuser channels, force plate ramps and fluid densifier channels.

* * * * *